US005750227A

United States Patent [19]

Adams

[11] Patent Number: 5,750,227

[45] Date of Patent: May 12, 1998

[54] TILED SURFACE COVERING

[75] Inventor: David J. Adams, Lancaster, Pa.

[73] Assignee: Armstrong World Industries, Inc., Lancaster, Pa.

[21] Appl. No.: 767,278

[22] Filed: Dec. 16, 1996

[51] Int. Cl.[6] ..... B32B 7/06

[52] U.S. Cl. ..... 428/42.2; 428/48; 52/390

[58] Field of Search ..... 428/48, 47, 49, 428/50, 42.2; 52/390, 392

[56] References Cited

U.S. PATENT DOCUMENTS

| | | | |
|---|---|---|---|
| 3,270,473 | 9/1966 | Smith | 52/390 |
| 3,902,293 | 9/1975 | Witt et al. | 52/392 |
| 4,242,390 | 12/1980 | Nemeth | 428/47 |
| 4,649,069 | 3/1987 | Tone | 428/82 |

*Primary Examiner*—Alexander Thomas

[57] ABSTRACT

A structure of tiles comprising numerous tiles which together form a surface covering, wherein at least part of each tile rests on a piece of underlay that lays between the surface covered and the tile. The piece of underlay had previously been fixed to the tile (having pressure-sensitive adhesive). In the embodiments of this invention, the underlay, optionally and preferably, is still attached to the tile forming an underlay which is permanently fixed to the tile. The surface covering of the present invention comprises tiles, each tile being square or rectangular, and having two opposed surfaces, wherein the tile has edges A, B, C, and D, between the surfaces and further has a coating of a pressure-sensitive adhesive and an underlay fixed to the surface having the coating of pressure-sensitive adhesive. The underlay extends beyond the surface a certain distance over adjacent edges C and D, wherein the underlay has an L-shaped release strip which can optionally be removed from the tile to expose the pressure-sensitive adhesive coating. Removal of the L-shaped strip exposes the coating on the tile in an area along adjacent edges A and B of the tile. After the removal of the L-shaped strip, the area of exposed surface extends a distance across the tile from edges A and B, wherein the distance across the tile is equal to or greater than the distance that the underlay extends beyond the surface over edges C and D.

6 Claims, 1 Drawing Sheet

TILED SURFACE COVERING

BACKGROUND OF THE INVENTION

Field of the Invention

This invention relates to a tiled surface covering. More particularly, this invention is concerned with surface covering tiles which carry an underlay sheet fixed to the tile. This underlay sheet is a layer beneath each tile. Advantageously, the installation of these tiles can create either floating or fixed floors.

Wall and floor tiles have been used which require adhesive to be laid on the foundation, followed by the securing of the tiles to the foundation by laying them over the adhesive. There have also been tiles used as surface covering where pressure sensitive adhesive was present in a layer on the back of each tile. The tiles were then secured to the surface by removing the release sheet and then pressing each tile to the surface where it was to be located. Such a system is described in U.S. Pat. No. 5,536,571.

Both of these types of tiles, however, suffer disadvantages. In each case, the tiles adhere directly to the surface underneath. In such cases, with the tile stuck directly to the surface such as the floor, floor movement will also directly affect the tile, causing tile movement. This movement prevents the sealing of seams between the tiles because the movement of the surface tends to tear apart the tiles.

Another disadvantage of these surface coverings is that they are fixed permanently to the surface. They cannot be removed easily. Scraping and even refinishing of the wooden surfaces is necessary. The tiles themselves are destroyed by their removal.

One wall and surface covering system which has temporary, removable tiles for both the floor and wall is described in U.S. Pat. No. 3,270,473 which uses L-shaped adhesive elements under each tile. The elements are arranged in a network which leaves a hollow rectangle in a reticular matrix of such rectangles arranged end to end in contiguous rows. Each tile is centered over the hollow rectangle and each side of the tile is centered over a length of the adhesive material. This floor covering system, however, leaves the tiles fixed directly to the surface underneath so that tile movement and seam splitting are still a problem.

Another surface covering system is taught in U.S. Pat. No. 3,902,293 which teaches the installation of a "Dimensionally-stable, resilient floor tile". According to this reference, a multilayer floor tile has a bottom layer which imparts durable resiliency because it is a sheet molded from a tangled network of thermoplastic fibers containing cells of gas at superatmospheric pressure. Wafer board provides the principal thickness of the floor tile and there can be one or two strata of wafer board. The top layer has the same rectangular dimensions as the contiguous strata of waferboard but is secured thereto in a staggered arrangement providing overhanging portions. This floor surfacing, however, is still difficult to remove, and there is no provision for the convenient sealing of the seams.

Accordingly, the present invention offers a floor covering system which can provide floating floors. The floating floors advantageously provide a flooring system which can be easily removed without scraping and refinishing the flooring surface. In addition to this, the floating floors do not experience the movement of the floor, and so the seams in the tile floor can be sealed. No movement of the floor underneath the tiles will cause the seams to tear apart.

SUMMARY OF THE INVENTION

The structure of tiles placed by the present invention comprises numerous tiles which together form a surface covering, wherein at least part of each tile rests on a piece of underlay that lays between the surface covered and the tile. The piece of underlay had previously been fixed to the tile (having pressure-sensitive adhesive). In the embodiments of this invention, the underlay could optionally and preferably is still attached to the tile, forming an underlay which is permanently fixed to the tile. When the underlay is not permanently fixed to the tile, the underlay was taken off of the tile and placed on the surface to be covered. The underlay could optionally have markings to show where the tile should be placed on the underlay.

The surface covering of the present invention comprises tiles, each tile being square or rectangular, and having two, opposed surfaces, wherein the tile has edges A, B, C, and D, between the surfaces, and further has a coating of a pressure-sensitive adhesive and an underlay fixed to the surface having the coating of pressure-sensitive adhesive. The underlay extends beyond the surface a certain distance over adjacent edges C and D, wherein the underlay has an L-shaped release strip which can optionally be removed from the tile to expose the pressure-sensitive adhesive coating. Removal of the L-shaped strip exposes the coating on the tile in an area along adjacent edges A and B of the tile. After the removal of the L-shaped strip, the area of exposed surface extends a distance across the tile from edges A and B, wherein the distance across the tile is equal to or greater than the distance that the underlay extends beyond the surface over edges C and D.

Where the distance across the tile is equal to the distance that the underlay extends beyond the surface over edges C and D, then each tile can be placed down so that the pressure-sensitive adhesive touches only the underlay extention from another tile. In this manner, even though the optional strip of underlay is removed, a floating floor covering can be put down which is not affected by floor movement and which can very easily be removed.

Where the distance across the tile from edges A and B is greater than the distance that the underlay extends beyond the surface over edges C and D, then each tile will, in part, adhere directly to the floor if the L-shaped release strip is removed. If the L-shaped release strip is not removed, then a floating floor can be laid.

DETAILED DESCRIPTION

The underlay of the present invention is a layer of some material which rests directly under the tiles and generally directly on the surface being covered. The underlay comes in square or rectangular sections directly attached to each tile.

The tile surface covering system of the present invention provides individual tiles which have an underlay attached to the tile. The underlay has an optionally removable L-shaped strip on the back of each tile. This optionally removable strip allows an L-shaped portion of the tile surface covering in each room or area to be anchored to the floor with the pressure-sensitive adhesive. If a completely floating floor is desired, however, the strip can be kept with the rest of the underlay sheet and put either under the tile on the floor, or it can be left permanently on the tile surface when it is installed. Thus, the underlay would still be attached to the tile surface covering and lays sandwiched between the tile and the floor.

Preferably, the sheet of underlay which is attached to each tile is utilized by stripping off the L-shaped piece, and then laying the tile with the remaining piece of underlay still attached to the tile onto the floor of the area to be covered. The remaining piece of underlay then becomes an attached layer between the floor and the tile.

Each tile has a portion of the underlay sheet extending beyond the tile, at least over edges C and D a certain distance. In preferred embodiments before the removal of the L-shaped strip, the underlay sheet extends beyond the tile over all four edges (A, B, C, and D). The overhang over edges A and B is optional, but when it is present, it is part of the optionally removable L-shaped strip which is preferably removed when the tile is installed.

In some embodiments, the tile will have a completely removable underlay which is removed from the tile and placed on the floor. The underlay is marked to indicate where the tile is laid on top of the underlay. Here the underlay preferably has the same length and width dimensions as the tile, and there is no removable L-shaped strip. In installation, the tile is laid on the underlay so that it is offset, allowing the extension of the underlay beyond the tile along edges C and D. Pressure sensitive adhesive will fix the underlay to the tile in the slightly offset manner. In this embodiment, also there will be a portion of the tile along edges A and B which either rests on the extension of underlay from other tiles, or is fixed to the floor (in cases where the underlay extension is not present).

In preferred embodiments, by having the L-shaped strip expose an area on the tile which is as wide as the overhang on edges C and D, a tile can be fixed to only the underlay when it is installed. In such a case, if a completely floating floor is desired, then the first tiles laid will keep the L-shaped strip attached. When keeping the L-shaped strip attached, it may be desired to have tiles with no overhang of the underlay across edges A and B, or the overhang over edges A and B may be cut off leaving the rest of the L-shaped strip attached to the tile. When enough tiles have been placed so that there are tiles with the underlay extending beyond the tile (over edges C and D), then the next tiles can have the L-shaped strip removed, and the tile can be fixed to the underlay to complete a floating floor.

In some embodiments, some of the tiles in the room have the L-shaped strip removed, and some of the tiles are anchored to the floor to create a partially floating floor (note FIG. 3, showing only a partially attached section). In such cases where a partially anchored floor is created, the floor covering will be anchored to the floor by the pressure-sensitive adhesive preferably in an L-shaped section of the room.

In other embodiments, the part of the tile exposed by the removal of the L-shaped strip can be larger than the amount of excess underlay from other tiles. In such a case, each tile will be partially stuck to the floor where the pressure-sensitive adhesive does not rest on the underlay.

The underlay can come in a variety of thicknesses. Preferably, it can range from about 1 mil to about 20 mils in thickness.

Any sheet material can be used for the underlay of the present invention. The underlay, for example, can be paper, a film such as a polymer film. The polymer film underlay can be made of the many polymers, for example, polyvinylchloride, polypropylene and polyethylene.

Preferred materials for the underlay are polyvinylchloride film and water resistant paper. If desired, the paper can optionally have a silicon coating over all or only part of it in order to make it easier to remove all or part of the underlay as needed.

OPERATION

A tile of the present invention is shown in FIG. 1. To install the tile to create a floating floor partially anchored to the floor, the L-shaped strip (3) is removed and the tile is placed. Since this is the first tile placed, there is no underlay from another tile to place the first tile on and thus the tile's exposed adhesive surface will fix the tile to the floor. By placing the tile directly next to the wall along both of the edges A and B (done in preferred embodiments), the number of tiles adhering to the floor in the room can be minimized to one row and one column. Other patterns of placing tile (such as when beginning in the middle of the room) will leave more tiles adhering to the floor if the removable L-shapes strip is removed. In addition to this, the extension of underlay over edges C and D require that the tiles be placed so that the underlay is laid on the floor being covered.

For these reasons, it is preferred to start placing the first tile so that edges A and B of the tile are adjacent to walls. In such a case, except for the first row and the first column in the room, the tiles placed will rest on underlay which extends beyond edges C and D of the other tiles in place. FIG. 3 shows three tiles in a row, the first tile having the L-shaped strip of underlay still attached. If desired, the overlap over edges A and B of such a tile can be trimmed. Optionally the tile could have no overlap over edges A and B. By not removing the L-shaped strip in such tiles, a completely floating floor can be laid.

FIG. 3 also shows two tiles next to each other in a second row. The first tile in the row of two tiles is the tile adjacent to the first tile placed, and this first tile of the second row forms a column with the first tile. In FIG. 3 the first row and the first column each show tiles which are adhering to the floor starting at points (6) and, in fact, adhere in the whole area of the tile which is exposed by the removal of the underlay but which does not rest on any other underlay protruding from other tiles.

In laying a floor, when a second tile is placed, it is adjacent to the first tile so that the adhesive-coated L-shaped strip of the second tile (exposed by the removal of the L-shaped piece of underlay) is put along edge D (10) or C (9) of the tile already in place. The second tile placed will adhere to the floor along one edge, and part of the tile will adhere to the underlay which protrudes from the first tile. Successive tiles are then placed adjacent to the tiles already in place until the floor is completely covered. Whenever edges A and B of the tile being placed can be put adjacent to an edge C and D from two other tiles, the tile being placed will float completely and will not adhere to the floor at all (unless the L-shaped strip is wider than the extension of the underlay over edges C and D).

PREFERRED EMBODIMENT OF THE PRESENT INVENTION

Figure 1:
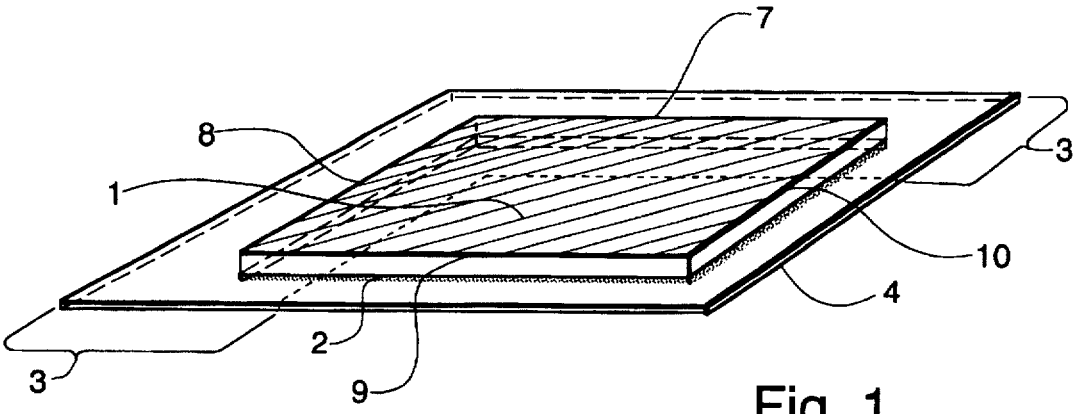
FIG. 1 shows a tile 1 with the entire underlay sheet 4 attached to the tile. The removable L-shaped strip of underlay is indicated by 3. The layer of pressure sensitive adhesive 2 holds the underlay on. If desired, only the removable L-shaped strip 3 can be made removable (by such means as a release coating). Also shown are edges A (7), B (8), C (9), and D (10). Permanent extension of the underlay 4 past edges C and D can be noted.
Figure 2:
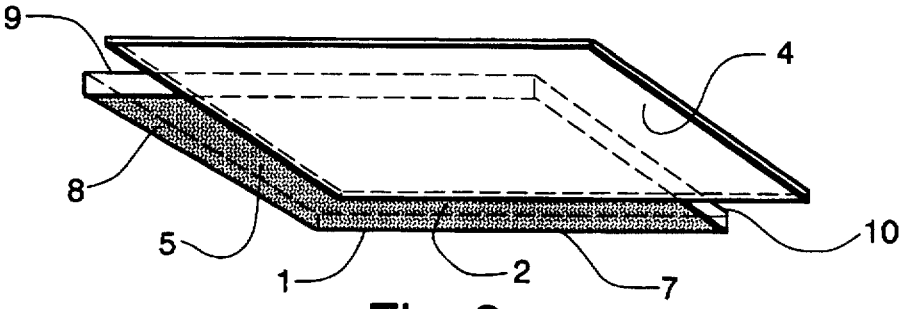
FIG. 2 shows the underside of the tile 1 (face up), after the removable L-shaped strip has been taken off. The underside of the tile 5 is seen with the layer of pressure sensitive adhesive 2 on it. Edges A (7), B (8), C (9), and D (10) can also be noted. Permanent extension of the underlay 4 past edges C and D can be noted.
Figure 3:
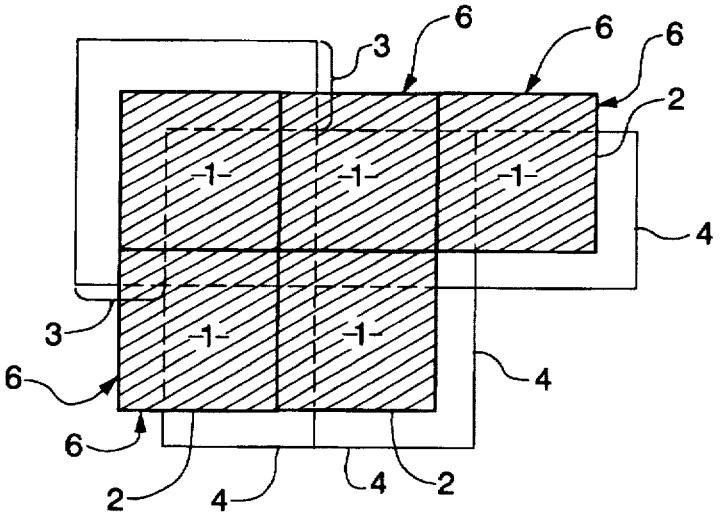
FIG. 3 shows five tiles (1) as they may be placed to cover a floor. Although it is preferred to take off the removable L-shaped strip, the first tile shows the strip attached as an alternative. The extension of the underlay 4 past edges C and D can be noted. Three tiles adhere to the floor at 6. The layer of pressure sensitive adhesive 2 is also noted, holding on the underlay 4.

Most preferably the removable L-shaped strip is taken off each tile. The first tile is placed adjacent to the walls in the room of the floor being covered. Successive tiles also have the L-shaped strip removed and are placed next to a previously placed tile. In the first column and row of the tile covering on the floor, each tile will be adhering to the floor in part (6 of FIG. 3). Whenever possible, successively placed tiles also have the adhesive (exposed by the removal of the L-shaped strip) placed on the underlay as it extends passed edges C and D of previously placed tiles. Most of the floor covering will then be a floating floor covering which advantageously can have the seams sealed without danger of being damaged by the movement of the floor beneath. Also advantageously, the non-attached tiles are easily removed without any need to clean or refinish the floor structure underneath.

I claim:

1. A surface covering system comprising a plurality of tiles, each tile being square or rectangular, and having two, opposed surfaces, wherein each tile has edges A, B, C, and D between the two surfaces wherein edge A is adjacent to edge B at one corner, and edge C is adjacent to edge D at one corner, and further wherein each tile has a coating of a pressure sensitive adhesive and an underlay adhering to the surface having the coating of pressure sensitive adhesive, wherein further, the underlay extends beyond the surface a certain distance over edges C and D, wherein the underlay has an L-shaped release strip which can optionally be removed from the tile to expose the pressure sensitive adhesive coating wherein removal of the L-shaped strip exposes the coating on each tile in an area along edges A and B of each tile, wherein further after the removal of the L-shaped strip the area of exposed coating surface extends a distance across the tile from edges A and B, wherein the distance across the exposed coating on the tile is equal to or greater than the distance that the underlay extends beyond the surface over edges C and D.

2. The system of claim 1 wherein the underlay is a water resistant paper.

3. The system of claim 1 wherein the underlay is a polyvinylchloride film.

4. The system of claim 1 wherein the underlay has a thickness in the range of from about 1 to about 20 mils.

5. The system of claim 1 wherein the distance across the tile is equal to the distance that the underlay extends beyond the surface over edges C and D.

6. The surface covering system of claim 5 wherein the plurality of tiles are laying together on a floor surface thereby forming a floating floor covering.

* * * * *